US010119761B1

(12) United States Patent
Scheurer et al.

(10) Patent No.: US 10,119,761 B1
(45) Date of Patent: Nov. 6, 2018

(54) PAINT CARD DRYING BOARD AND PAINT CARD DRYING METHODS

(71) Applicants: Randy Scheurer, Liberty Lake, WA (US); Shawn Watson, Rathdrum, ID (US)

(72) Inventors: Randy Scheurer, Liberty Lake, WA (US); Shawn Watson, Rathdrum, ID (US)

(73) Assignee: Randy Scheurer, Liberty Lake, WA (US)

( * ) Notice: Subject to any disclaimer, the term of this patent is extended or adjusted under 35 U.S.C. 154(b) by 689 days.

(21) Appl. No.: 14/664,463

(22) Filed: Mar. 20, 2015

Related U.S. Application Data

(60) Provisional application No. 61/968,303, filed on Mar. 20, 2014.

(51) Int. Cl.
*F26B 5/00* (2006.01)
*F26B 9/00* (2006.01)
*F26B 9/10* (2006.01)

(52) U.S. Cl.
CPC . *F26B 5/00* (2013.01); *F26B 9/10* (2013.01)

(58) Field of Classification Search
CPC .. F26B 5/00; F26B 9/10; F26B 21/001; F26B 21/004; F26B 25/18; F26B 21/14; F26B 13/101; F26M 13/00; B05D 3/007; D05B 3/04; D21F 5/042; B05C 11/06; B05C 9/14; A41F 11/02; B60R 13/0206; D06F 58/10; B41F 23/00
USPC ..... 34/239, 414, 443, 444, 611, 614, 618, 34/621, 622, 623, 629, 638; 427/377, 427/378; 434/430; 118/643
See application file for complete search history.

(56) References Cited

U.S. PATENT DOCUMENTS 1,767,745 A * 6/1930 Day ..... G09F 1/10 24/458
2,994,134 A * 8/1961 Adams ..... G03D 15/027 34/145

(Continued)

OTHER PUBLICATIONS

Ebay, "Devilbiss Aerodry 2 Gun Waterbourne Paint Air Dryer Stand Drying Blower Auto Car" available online at: http://www.ebay.com/itm/Devilbiss-Aerodry-2-GUN-WATERBOURNE-PAINT-AIR-DR . . . , printed Dec. 12, 2013, 3 pages.

*Primary Examiner* — Nathaniel Wiehe
*Assistant Examiner* — Timothy J Teicher
(74) *Attorney, Agent, or Firm* — Wells St. John P.S.

(57) ABSTRACT

Paint card drying assemblies are provided that can include a substrate configured to support cards and a drying assembly coupled to the substrate. Methods for drying paint cards are provided that can include providing a drying assembly coupled to a substrate, aligning cards below the drying assembly, and providing gas through the drying assembly and along the face of the cards to dry paint applied to the cards. Assemblies can also include a substrate configured to support cards, horizontally opposing handles aligned along lateral edges of the substrate, and a drying assembly coupled to the substrate and aligned between the handles upon one face of the substrate, the drying assembly comprising conduit in fluid communication with a plurality of flat-nosed nozzles evenly distributed along the conduit, each of the plurality configured to direct a gas stream along the face of the substrate.

5 Claims, 3 Drawing Sheets

(56) References Cited

U.S. PATENT DOCUMENTS

| | | | | |
|---|---|---|---|---|
| 3,258,854 | A * | 7/1966 | Ascoli | B05C 13/00 211/132.1 |
| 4,265,038 | A * | 5/1981 | Crosslen | A47F 7/145 40/124.2 |
| 5,746,600 | A * | 5/1998 | Chang | B44D 3/003 434/367 |
| 5,766,792 | A | 6/1998 | Thomas | |
| 5,924,619 | A * | 7/1999 | Bartell | B41F 13/02 226/7 |
| 6,036,645 | A | 3/2000 | Jones | |
| 7,726,040 | B2 * | 6/2010 | Yanes | F26B 13/007 34/205 |
| 2010/0163653 | A1 | 7/2010 | Pucciani | |

* cited by examiner

PAINT CARD DRYING BOARD AND PAINT CARD DRYING METHODS

CROSS REFERENCE TO RELATED APPLICATION

This application claims priority to U.S. Provisional Patent Application Ser. No. 61/968,303 which was filed on Mar. 20, 2014, the entirety of which is incorporated by reference herein.

TECHNICAL FIELD

The present disclosure relates to painting apparatus and methods, and in particular embodiments, the present disclosure relates to the painting of industrial items such as automobiles and other items that are painted within what are typically referred to as clean rooms or paint rooms.

BACKGROUND

Many industrial items are painted in clean rooms, and it may be desirable to repaint those items at a later time. Some items that are painted on a routine basis include items such as automobiles. There can be many reasons to paint an automobile; it may be a newly manufactured automobile, or it may be an automobile that needs to be repainted, or to repaint after an accident upon repair of the automobile.

In the past, what has occurred is that automobiles will be painted in accordance with a code that is provided by the manufacturer, and this code relates to a certain mixture of paint that can be utilized to match paint that is already on the automobile. However, using these codes typically does not result in a match. The remaining paint on the car may be faded or changed in some form because of time. To match paint, typically some manipulation of the paint beyond the manufacturer's code is required.

Part of this manipulation includes spraying cards, allowing the cards to dry, and then placing the card proximate the old paint on the automobile, and determining a match. These cards typically have a code on the back that indicates the exact mixture that was utilized to prepare the paint on that card. Painters in automobile body shops throughout the country typically maintain portfolios of these cards. During the preparation of these cards, it can be difficult to spray the cards and allow them to dry within the clean room. To date, there has not been a convenient way to spray, dry, and maintain these cards in the clean room while they are being dried.

The present disclosure provides methods and apparatus that can be utilized to dry one or more cards, as well as a convenient place to store the cards while they are drying.

SUMMARY OF THE DISCLOSURE

A paint card drying assembly is provided that can include a substrate configured to support cards and a drying assembly coupled to the substrate and configured to provide a gas stream along the face of at least some cards supported by the substrate.

Methods for drying paint cards are also provided, the methods can include providing a drying assembly coupled to a substrate, aligning cards below the drying assembly, and providing gas through the drying assembly and along the face of the cards to dry paint applied to the cards.

Paint card drying assemblies are also provided that can include a substrate configured to support cards, horizontally opposing handles aligned along lateral edges of the substrate, and a drying assembly coupled to the substrate and aligned between the handles upon one face of the substrate, the drying assembly comprising conduit in fluid communication with a plurality of flat-nosed nozzles evenly distributed along the conduit, each of the plurality configured to direct a gas stream along the face of the substrate.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 1:
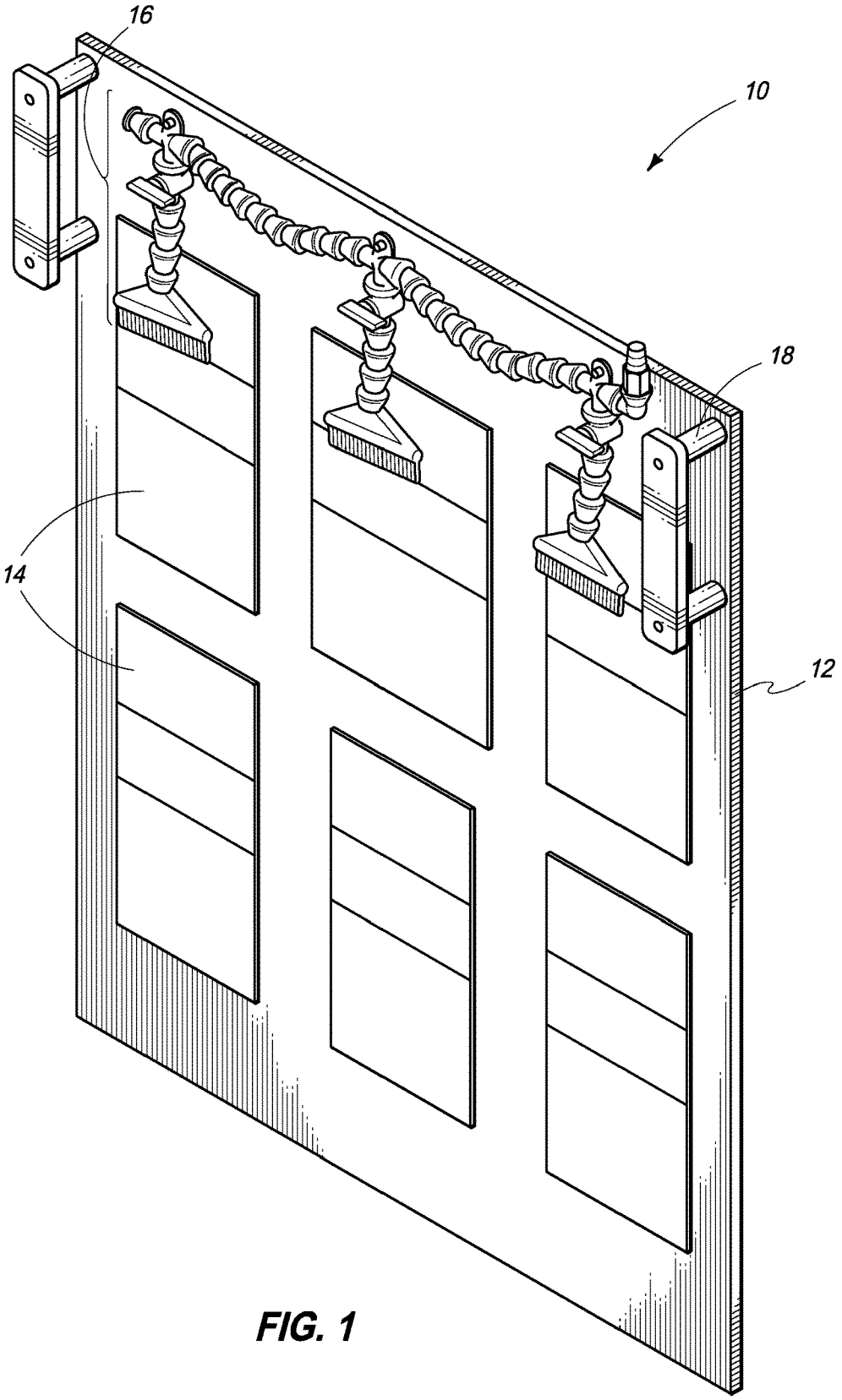
FIG. 1 is an apparatus according to an embodiment of the disclosure.

The present disclosure will be described with reference to FIGS. 1-3. Referring first to FIG. 1, a card drying assembly 10 is shown that includes a substrate 12 that can support multiple paint cards, for example. As described above, paint cards can be painted with a pre-formulated mix, and the cards can be placed on the substrate 12. Substrate 12 may be manufactured of numerous materials. Example materials that can be utilized include wood, plastic, and/or steel materials.

Substrate 12 can support a plurality of paint cards 14 as shown in a rowed and column manner, and other arrangements of cards upon substrate 12 may be utilized as well. Cards 14 can be cellulose-based cards, such as paper and/or paperboard cards.

Substrate 12 may also include a drying assembly 16. Drying assembly 16 can be situated towards the upper portion of substrate 12 and can be configured to direct an air flow down, across, and parallel to the upper surface of substrate 12, thereby conveying air across the upper surface of cards associated with substrate 12. According to example implementations, substrate 12 may also include handles 18 that can be aligned opposing one another along the edges of substrate 12 and aligned along the upper portion of substrate 12 that allow the user to pick up assembly 10 and place it either on a wall, and/or lean assembly 10 against a wall, while cards 14 are in the process of drying.

Figure 2:
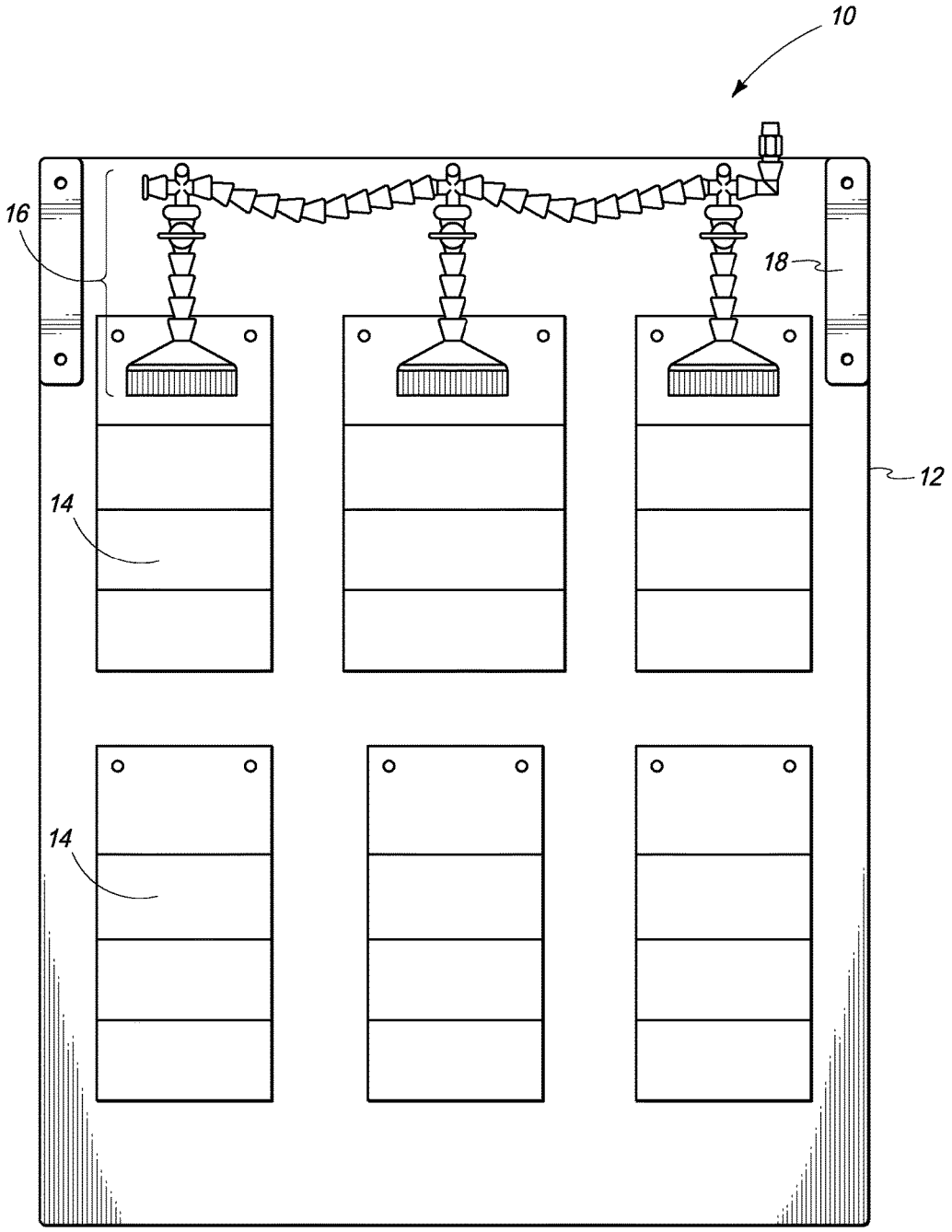
FIG. 2 is another view of the apparatus according to an embodiment of the disclosure.

Referring next to FIG. 2, an elevational view of assembly 10 is shown. As can be seen in this view, drying assembly 16 can include nozzles that are aligned in specific pathways down the face of substrate 12. Along these pathways can be aligned cards 14 that can be aligned along the path of the nozzles of assembly 16. In accordance with example implementations, for every column of cards, a nozzle may be associated therewith, and there can be at least two rows of cards within each column.

Figure 3:
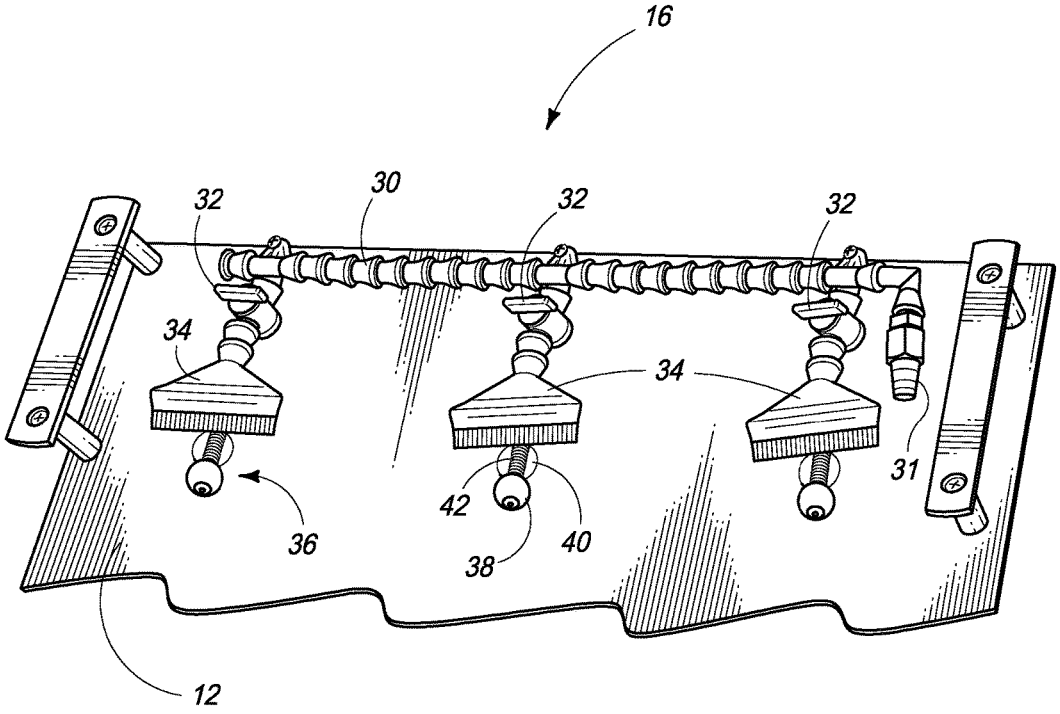
FIG. 3 is a partial view of the apparatus according to an embodiment of the disclosure.

Referring next to FIG. 3, a more detailed view of the drying assembly 16 is shown. Drying assembly 16 can include a conduit or tubing 30 that can extend from a coupling assembly such as air coupling assembly 31. This coupling assembly can be configured to connect to a compressor that can provide air flow through air coupling assembly 31 and into tubing 30. Tubing 30 can be in fluid communication with control valves or on/off valves 32.

Valves 32 can be associated with each individual nozzle 34, or in accordance with other embodiments, the valve may be associated with tubing 30 proximate air coupling assembly 31 to allow for the control of air flow to all of the nozzles rather than to individual ones of nozzles 34.

According to example implementations, a coupling assembly 36 can be provided through substrate 12 and associated therewith to allow for the coupling of cards thereto. In accordance with example implementations, this coupling assembly 36 can include a biasing member 42 such as a spring that is attached through an opening 40 to the reverse side of substrate 12. Extending to the other side of that is a member 38, which in this case can be, for example, a bulbous member that provides some resistance to the biasing of member 42. In accordance with example implementations, placards can be slid under member 38 and the biasing of 42 can provide enough pressure to member 38 to secure a card to substrate 12.

In accordance with example implementations, multiple cards can be placed on card drying assembly 10, dried, and allow the operator or painter to remove cards upon drying, and then match those cards with the proper paint formulation so that the car being painted will have paint that matches the old paint on the car.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

The invention claimed is:

1. A paint card drying assembly comprising:

a substrate supporting a plurality of painted cards aligned in a plurality of rows and columns, wherein a face of each of the painted cards is aligned parallel with a support surface of the substrate; and a drying assembly coupled to the substrate above the plurality of rows and columns, and configured to provide a gas stream parallel with each face and the support surface along the face of each of the plurality of the painted cards supported by the substrate, wherein the drying assembly comprises a plurality of nozzles, each of the plurality of nozzles being vertically aligned with each of the plurality of columns.

2. The paint card drying assembly of claim 1, wherein the substrate comprises wood, plastic, and/or steel.

3. The paint card drying assembly of claim 1, wherein the cards comprise cellulose.

4. The paint card drying assembly of claim 1, further comprising a pair of handles extending from the substrate.

5. The paint card drying assembly of claim 1, wherein the drying assembly comprises a conduit coupled to one or more of the plurality of nozzles.

* * * * *